United States Patent [19]

Sartorio

[11] Patent Number: 4,735,079

[45] Date of Patent: Apr. 5, 1988

[54] METHOD AND APPARATUS FOR THE MECHANICAL MANIPULATION OF METAL SHEETS, PARTICULARLY FOR FOLDING OPERATIONS

[75] Inventor: Franco Sartorio, Turin, Italy

[73] Assignee: Prima Industrie S.p.A., Turin, Italy

[21] Appl. No.: 880,735

[22] Filed: Jul. 1, 1986

[30] Foreign Application Priority Data

Jul. 15, 1985 [IT] Italy ..... 67649 A/85

[51] Int. Cl.[4] ..... B21D 43/00

[52] U.S. Cl. ..... 72/422; 414/731

[58] Field of Search ..... 414/730, 731; 72/389, 72/420, 422

[56] References Cited

U.S. PATENT DOCUMENTS 4,557,135 12/1985 Ragettli et al. ..... 72/422

*Primary Examiner*—Lowell A. Larson

*Attorney, Agent, or Firm*—Omri M. Behr

[57] ABSTRACT

A process is described which allows metal sheets of different dimensions to be manipulated in a automatic manner by means of a numerically controlled robot provided with a pair of mechanical pincers; it consists in positioning the metal sheet onto a support table carried by a rotatable base to effect rotation thereof parallel to its own plane having previously released the metal sheet by the pincers, and, for metal sheets of large dimensions, displacing, with the pincers, both the metal sheets and the table on which it is lying simultaneously, which table is removable from the said base.

11 Claims, 4 Drawing Sheets

METHOD AND APPARATUS FOR THE MECHANICAL MANIPULATION OF METAL SHEETS, PARTICULARLY FOR FOLDING OPERATIONS

BACKGROUND OF THE INVENTION

The present invention relates to a process for effecting the automatic manipulation of metal sheets of different dimensions by manipulator devices with exclusively mechanical holding members. The invention further relates to an automatic system for the folding of metal sheets which puts this method into practice.

It is known that the folding of metal sheets by means of folding presses is an operation which is difficult to automate both because of the complex movements to which the metal sheets must be subjected, particularly during the folding phase, and above all because of the wide variety of forms of metal sheet to be folded; if, in fact, manipulators with gripping members of mechanical type are used for metal sheets of small dimensions, for metal sheets of large dimensions, which flex during the handling if they are not adequately supported, it is necessary to employ particular tools comprising frames having a plurality of gripping points constituted by magnets or vacuum suckers; such tools, apart from the relatively high cost, are carried directly by manipulator arms and because of their bulk limit the movements of the arms themselves; moreover, such tools cannot always be utilised in that the metal sheets to be worked may not be made of ferro-magnetic materials making the magnets useless, or else have complex forms and are perforated thereby making the vacuum suckers ineffective. The main disadvantage however lies in the necessity of effecting frequent changes of the handling tools if it is necessary to work metal sheets of different dimensions on the same installation and this, which is something which cannot be effected automatically (at least not without providing a further manipulator robot for effecting the tool change, with a doubling of the installation costs) severely limits the possible increase in productivity obtainable over traditional manual handling of the metal sheets by human operators.

SUMMARY OF THE INVENTION

The object of the invention is that of providing a process which allows the automatic handling of metal sheets of different dimensions by utilising manipulator arms provided with gripping members of exclusively mechanical type. A further object of the invention is that of providing a metal sheet folding installation capable of working metal sheets of different dimensions in an entirely automatic manner and with low costs.

The said objects are achieved by the invention which relates to a method for effecting the mechanical manipulation of metal sheets of different dimensions, particularly to serve a folding press in an automatic manner, characterised by the fact that it comprises the following phases:

disposing on a rotatable base, for rotation therewith, a support table of dimensions similar to, and preferably less than, along at least one side, those of the metal sheets to be manipulated;

gripping the metal sheet to be manipulated by means of a pair of opposed pincers able, respectively, to grip the edges of the said metal sheet and to displace the said pincers along three Cartesian axes in such a way as selectively to position the said metal sheet in a plurality of spatially different positions: and turning the said metal sheet parallel to its own plane by laying it on the said support table by displacement of the said pincers, then making the said base rotate through a desired angle after the said pincers have released the said metal sheet.

The invention also relates to a system for effecting the automatic folding of metal sheets of different dimensions comprising at least one folding press, displacement means for the said metal sheets, and at least one robotised numerically controlled manipulator device operable to position the said metal sheets selectively, one at a time, in a plurality of predetermined positions in which the said metal sheets are to be worked by the said folding press, characterised by the fact that it comprises a rotatable base disposed between the said manipulator device and the said folding press and a support table for the said metal sheets fixable for rotation with the said base, this latter and the said manipulator device being controlled by a common central control unit and the said support table being shaped in such a way that it can be gripped by the said manipulator device together with a said metal sheet lying thereon and rigidly connected thereto.

BRIEF DESCRIPTION OF THE DRAWINGS

The invention will now be non-limitatively described with reference to the attached drawings, in which.

Figure 1:
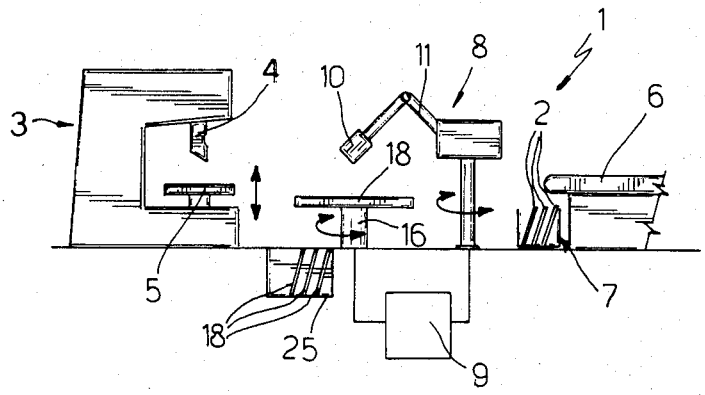
FIG. 1 schematically illustrates, in side view, a folding system formed according to the invention.
Figure 8:
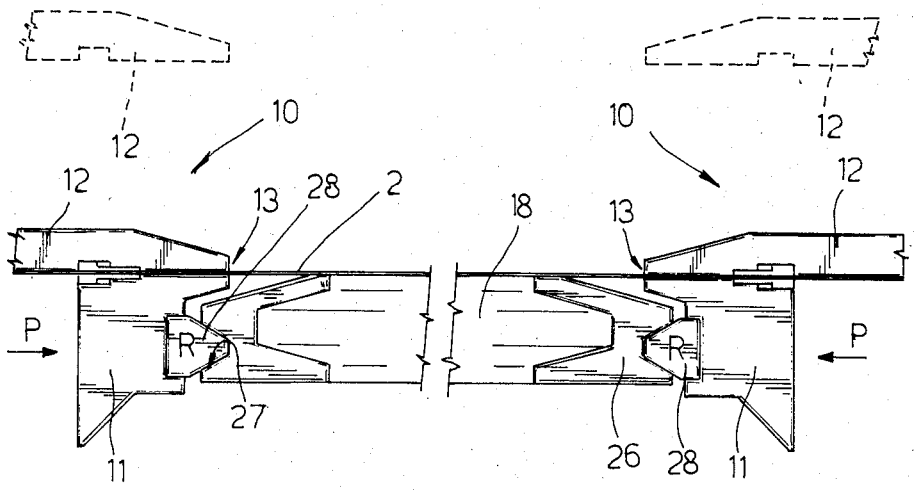

FIGS. from 3 to 7 and 9 and 10 illustrate different stages of the method according to the invention;

FIG. 8 schematically illustrates on an enlarged scale a further detail of the system of FIG. 1.

DETAILED DESCRIPTION OF THE INVENTION

Figure 2:
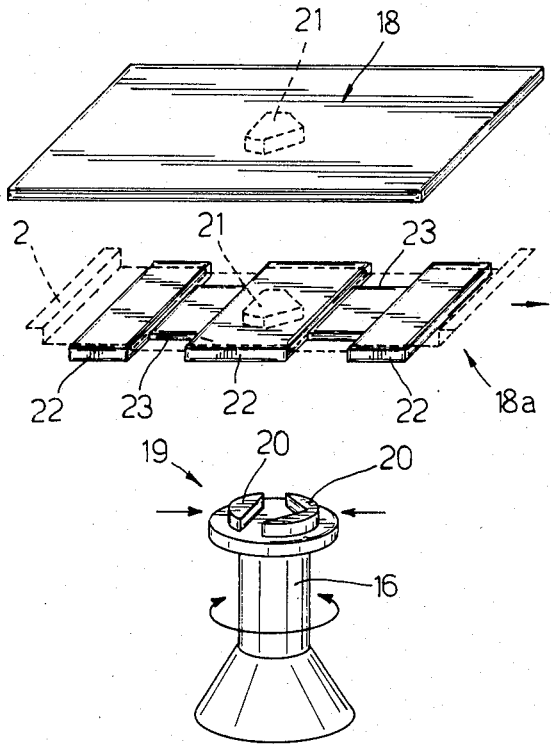
FIG. 2 illustrates a perspective view on an enlarged scale of a detail of the system of FIG. 1.
Figure 10:
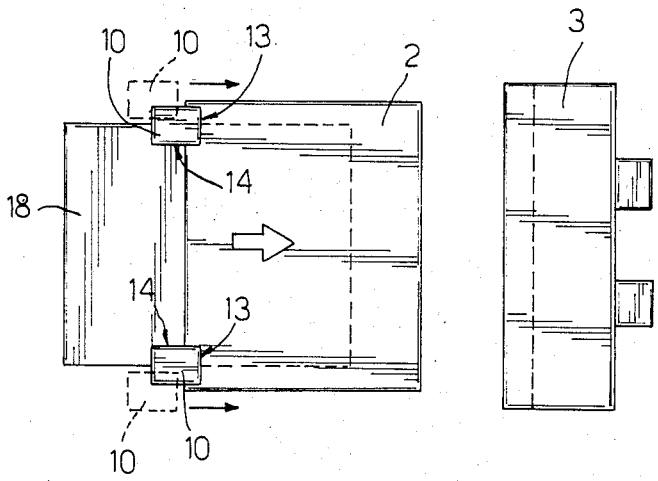

With reference to FIGS. 1, 2 and 8 there is generally indicated with the reference numeral 1 a system for effecting the automatic folding of metal sheets 2 of different dimensions variable within a wide range by means of one (or more) folding presses 3 of known type comprising a blade 4 and a vertically movable anvil or die 5. The system 1 obviously includes, as well as the folder 3, means for movement of the metal sheets 2, constituted for example by a conveyor belt 6 of known type for the discharge of the folded metal sheets and by a movable magazine or "pallet" 7 containing the metal sheets 2 to be worked and movable in a known way by means of a further conveyor of any known type not illustrated for simplicity, and at least one robotised numerically controlled manipulator device 8 controlled by a central control unit 9, for example a microprocessor provided with a pair of gripping pincers 10 carried by one or more movable arms 11. The device 8 which for example can be composed of a pair of single arm manipulator robots of known type, controlled by the same central control unit 9 and each provided with a single pincer 10 or else by a single robot having two arms or otherwise provided with both the pincers 10, is operable selectively to grip the metal sheets 2 one at a time from the magazine 7 and to displace these along the Cartesian axes in such a way as selectively to position the metal sheets 2 in a plurality of different predetermined spatial positions memorised in the central control unit 9 or calculated thereby in accordance with suitable parameters set in by an operator, in which the metal sheets 2 are to be worked by the folder 3; the pincers 10 are of mechanical type and each comprise a lower fixed jaw 11 and an upper jaw 12 movable with respect to the jaw 11 in a known way; the jaws 11 and 12 are secured to the device 8 in a such a way as to be rotatable through 360° about an axis parallel to the plane in which they lie and each has at least two adjacent gripping sides 13 and 14 (FIG. 10) disposed substantially at a right angle to one another and operable to grip respective perimetral edges of the metal sheets 2. The manipulator device 8, whatever its structure, must be able, according to the invention, to displace the pincers 10 towards one another in such a way as to vary their separation in dependence on the dimensions of the metal sheet 2 to be gripped. This is obtainable in a known manner not illustrated for simplicity, for example by utilising a device 8 in which the pincers 10 or the members which carry them, are mounted slidably along a transverse rail.

According to the invention, the system 1 further includes a rotatable base or pedestal 16 disposed between the manipulator device 8 and the folding press 3 and at least one rigid support table 18 for the metal sheets 2, which is fixable for rotation with the base 16 by means of a self-centering attachment device 19 of known type, comprising for example two jaws 20 carried at the top of the base 16 and between which can be inserted a locating block 21, which may be for example triangular, formed on a lower face of the table 18; this latter is preferably made of a composite material of honeycomb structure in a single panel, or else, in a variant 18*a* (FIG. 20, in a plurality of panels 22 of small dimensions slidably mounted and separated from one another by a pair of stringers 23 in such a way as to guarantee an optimum support for the metal sheet 2 to be worked even when this has already been folded. The support table 18 which is used must have dimensions similar to and preferably less than, at least along one side, those of the metal sheet to be worked, in such a way that the perimetral edges of this which are to be folded project from the table 18; since the system 1 must be able to work metal sheets 2 of very different dimensions, it is provided preferably with a plurality of support tables 18 of different dimensions, but all with an identical fixing block 21, which when they are not utilised are housed in a store 25 disposed in a position adjacent the base 16; the device 19 guarantees the interchangeability of the different tables 18 on the base 16, and these latter are shaped in such a way as to be able to be gripped by the pincers 10; the manipulator device 8 is thus able to grip not only the metal sheets 2, but also the tables 18, which are selectively taken up thereby in dependence on the programme loaded into the central control unit 9, and disposed on the base 16 in dependence on the dimensions of the metal sheet 2 to be worked. As will be better described hereinbelow, the tables 18 serve to simplify the handling of the metal sheet 2 and for this purpose must be able to be gripped, together with the metal sheet 2 being worked, by the pincers 10 and retained thereby independently of the metal sheet 2 itself. According to the invention, therefore, each support table 2 includes (FIG. 8) a perimetal edge 26 provided with a continuous groove 27 shaped in section as a V-shape channel, and the jaws 11 of the pincer 10 provided with respective projecting elastomeric blocks or plugs 28 which are rectilinear and able to engage with the grooves 27 of the various tables 18; it is clear that by arranging the pincers 10 with the plugs 28, which are preferably made of rubber, on opposite sides of the table 18 in use, inserted between opposite sections of the groove 27, the table 18 will be engaged between the pair of pincers 10 of the device 8 without by this obstructing the opening of the jaws 12 and can be handled by the device 8 alone or together with a metal sheet 2 being worked and in any case independently of this latter. It is therefore possible for the device 8 to position or remove the table 18 from the base 16 simply by vertical lowering or raising thereof; by positioning the pincers 10 in such a way as to slightly compress the plugs 28 it is further possible for the device 8 to dispose the table 18 in any spatial position, even inclined, in that in this case the table 18 remains gripped by friction between the plugs 28 of the pincers 10, thereby avoiding any possibility of accidental slipping.

According to the invention the sense and amount of rotation of the base 16 are controlled by the central control unit 9 in dependence on the movements of the pincers 10 thanks to the fact that the central control unit 9 is connected both to the manipulator 8 and to the drive motor for the base 16, not illustrated for simplicity. Making reference to FIGS. from 3 to 5 and 9 and 10, the programme memorised in the central control unit 9 determines the manipulation of the metal sheets 2 to be worked by means of a succession of operations comprising, in each case, at least three fundamental phases;

(1) arrangement on the base 16 of the table 18 of suitable dimensions with respect to those of the metal sheet to be displaced, having taken the table from the store 25 by means of the pincers 10 moved by the manipulator device 8;

(2) gripping the metal sheet to be displaced by the pincers 10 and actuation of the device 8 by the central control unit 9 in such a way as to bring the metal sheet 2 into one or more successive positions established by the programme or calculated by the central control unit 9 itself in dependence on parameters introduced into it by an operator;

(3) effecting rotation of the metal sheet being worked, parallel to the plane in which it lies, this operation being absolutely necessary to be able to fold in succession all the edges of the metal sheet in the same sense, by resting the metal sheet on the previously positioned table 18, releasing the metal sheet from the pincers 10 and rotation of the base 16 controlled by the central control unit 9 to the desired angle (usually 90° or 180°).

Figure 3:
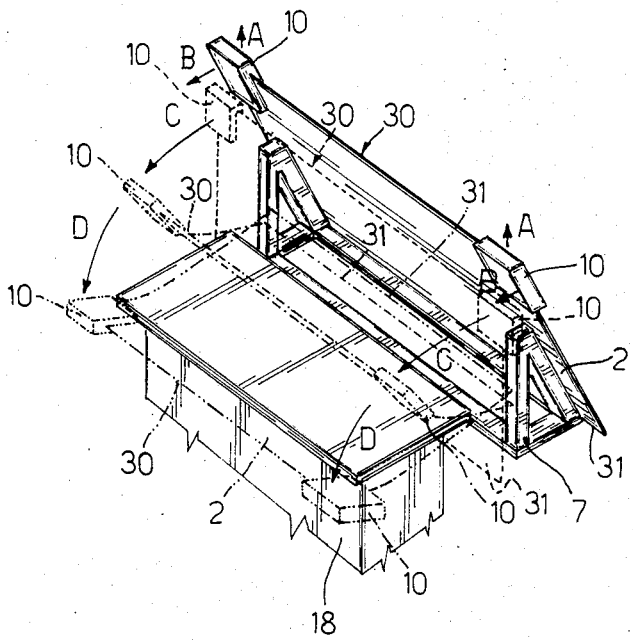
Figure 4:
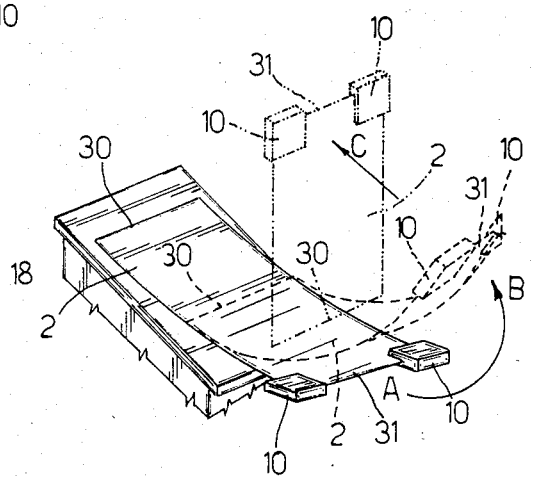
Figure 5:
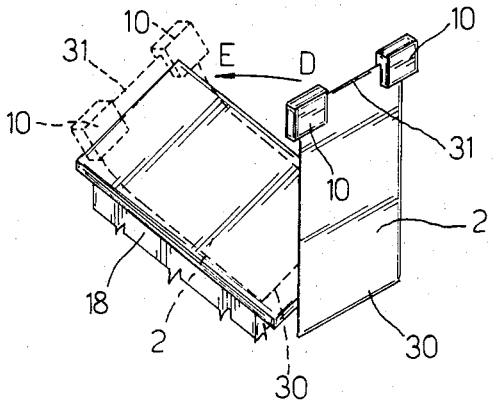

In particular, in the case of metal sheets of relatively large dimensions, each metal sheet 2 is taken from the store 7, with both pincers 10 gripping the same upper edge 30, and then, by displacing the pincers 10 in such a way as to maintain the metal sheet 2 constantly vertical, the metal sheet 2 is carried into contact with the table 18 and, with a compound movement of rotation and advancement of the pincers 10 (FIG. 3) is gently laid onto the table 18; by using the table 18 as an intermediate rest it is also possible, if necessary, to turn the metal sheet over through 180° by operating as illustrated in FIGS. 4 and 5; in particular, the metal sheet 2 previously laid on the table 18 is gripped by the pincers 10 in correspondence with an edge 31 opposite the edge 30 and with a compound rotation and displacement movement of the pincers 10, effected by the manipulator 8 under the control of the central control unit 9, carried into a vertical position (FIG. 4); subsequently the compound movement already performed upon removal of the metal sheet 2 from the store 7 is repeated, thus laying the metal sheet 2 onto the table 18 (FIG. 5) in a position turned through 180° in that the positions of the edges 30 and 31 are reversed with respect to those of FIG. 4.

Figure 9:
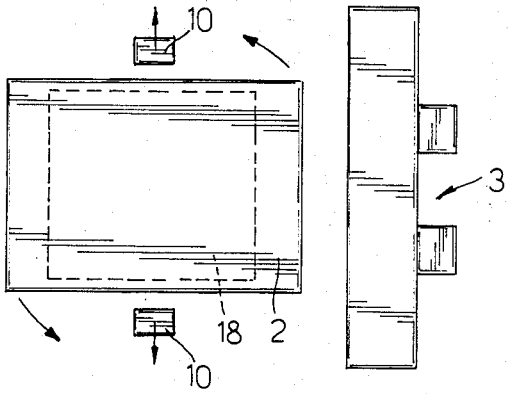

According to the invention, once the metal sheet 2 has been laid onto the table 18 in the most suitable position the pincers 10 are separated (FIGS. 6 and 9) and the table 18 turned in such a manner as to arrange the edge of the metal sheet 2 to be folded in front of the folder 3 parallel to the blade 4; during this stage the metal sheet 2 can be optionally maintained in contact with the table 18 by means of vacuum suckers 35 of known type provided on this latter which, because of the small stresses in operation are effective even in the presence of holes formed on the metal sheet 2. Finally (FIG. 7) the pincers 10 are positioned as in FIG. 8 in such a way as to grip both the table 18 (by means of the plugs 28 engaged in the groove 27) and simultaneously the metal sheet lying on it (the edges of which are gripped between the jaws 11 and 12), and then raised in such a way as to produce the release of the table 18 from the base 16; at this point the table 18 and the metal sheet 2 resting on it can be displaced together by the pincers 10 without making the metal sheet 2 flex, which is supported by the auxiliary support constituted by the table 18, and taken up by the folder 3, disposing the edge to be folded of the metal sheet 2 in contact with the blade 4. Once such positioning operations are terminated the central control unit 9 starts the folder 3 and to encourage the correct folding of the metal sheet 2 simultaneously displaces the pincers 10 towards the anvil 5 making these rotate towards the folder 3, and opens the jaws 12; in this way the table 18 is made to turn upwardly whilst the metal sheet 2 being folded is left free to slide on the table 18 under the action of the heavy force and stresses of the folding tools, simulating the behaviour of a manual sheet handling operator. It is clear that to effect the folding, however, it is necessary that the edge to be folded is located projecting from the table 18; this can be obtained by suitably manoeuvring the pincers 10 as the metal sheet 2 is deposited on the table 18, or else (FIG. 10) after the operation of rotation of the table 18 by means of the base 16 by pushing the metal sheet 2 by means of the pincers 10 after gripping them together with the table 18, in such a way as to make the metal sheet 2 move on the table 18 towards the folder 3.

Figure 6:
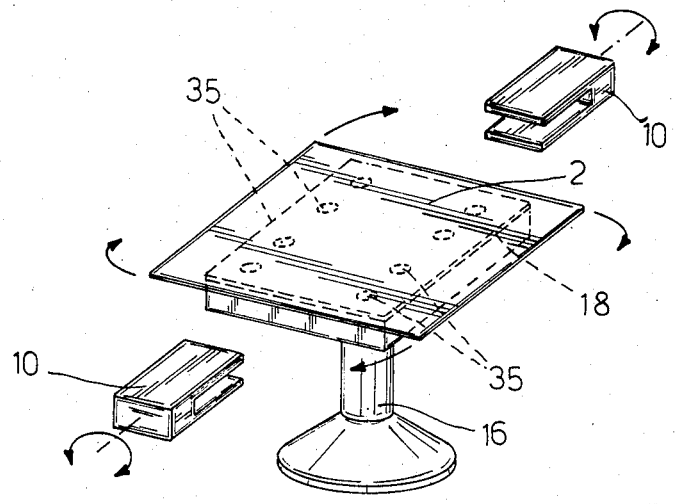
Figure 7:
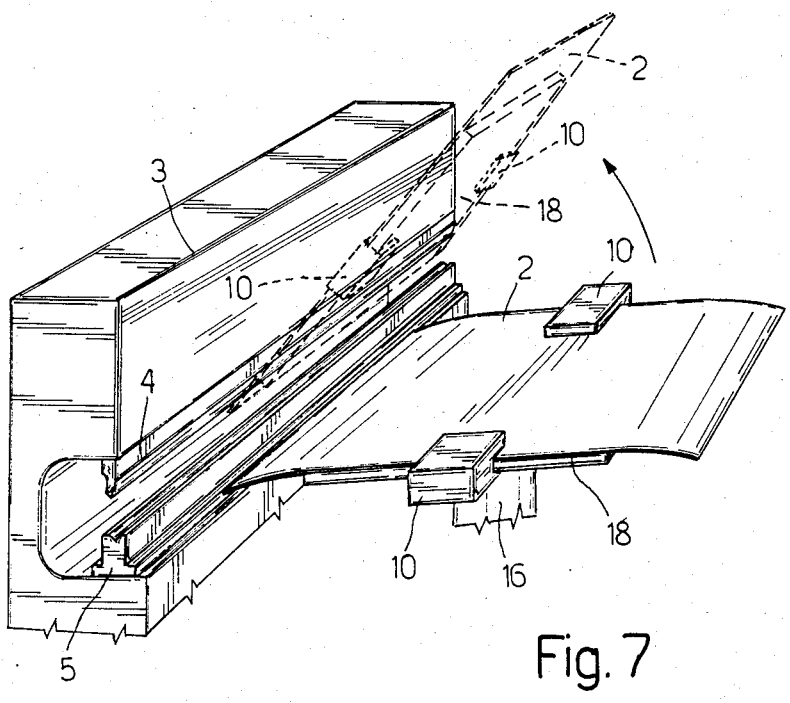

In the case of small metal sheets, on the other hand, these can be gripped and displaced using only the pincers 10 without utilising the table 18, which is used exclusively to effect movements of horizontal rotation of the metal sheet to be worked (FIG. 6).

From what has been described the advantages connected with the present invention will be apparent. Thanks to the use of the removable table 18 and a rotating base for same it is possible to effect all the necessary movements of the metal sheet with relatively simple manipulator devices, and above all of small size and relatively low costs; moreover the table 18 permits metal sheets of very different dimensions to be handled with the same manipulators and without effecting any change of gripper means and therefore permits systems of high productivity and high flexibility to be obtained. Finally, during the folding phase itself, the table 18, together with the particular pincer structure 10, permits the manual gripping of the metal sheet to be better simulated, allowing working of optimum quality to be obtained.

I claim:

1. A method for effecting the mechanical manipulation of metal sheets of different and relatively large dimensions, particularly to serve a folding press automatically, characterized in that it comprises the steps:

connecting with a rotatable base, for rotation therewith, a support table having dimensions similar to, and preferably less than, along at least one side, those of the metal sheet to be handled;

turning the said metal sheet parallel to its plane by laying it on the said support table by displacement of a pair of opposed pincers operable to grip respective edges of said metal sheet and then making the said base turn through a desired angle after the said sheet has been released by the said pincers; and positioning said metal sheet in a plurality of desired spatial positions by laying it on the said support table, by gripping simultaneously both said metal sheet and said support table by means of said pincers after said support table has been released by said rotatable base, and then by positioning in said plurality of desired positions said support table together with said metal sheet lying thereon by displacing said pincers along three Cartesian axes.

2. A method according to claim 1, wherein said metal sheet to be handled is laid on said support table by gripping said metal sheet by the said pincers on the same edge by displacing said pincers in such a way as to maintain said metal sheet constantly in vertical position, until said metal sheet is carried into contact with said support table, and then by rotating and advancing simultaneously said pincers.

3. A method according to claim 1, characterised by the fact that the said support table (18) is connected with said rotatable base (16) by means of the said pincers (10) after having been taken by the said pincers (10) from a store (25) adjacent to the said rotatable base (16) and containing a plurality of support tables (18) of different dimensions which are able to be mounted on the said rotatable base (16) for rotation therewith by means of an automatic self centering attachment device (19) of this latter.

4. A method according to claim 1, characterised by the fact that an edge of the said metal sheet (2) to be worked is positioned facing an operating machine (3) by rotation of the said support table (18) after the said metal sheet (2) has been laid onto the said table (18) and released, and is disposed projecting from the said support table (18) after the said rotation, by displacing the said metal sheet (2) on the said support table (18) by pushing the said metal sheet (2) with the said pincers (10).

5. A method according to claim 4, in which the said operating machine is a folding press (3), characterised by the fact that to effect working of the said edge, the metal sheet (2) is brought towards the said folding press (3) by displacing it, together with the said support table (18) by means of the said pincers (10) and by the fact that, during folding of the said edge, the said metal sheet (2) and the said support table (18) are made to turn upwardly by the said pincers (10), leaving the said metal sheet (2) free to slide on the said support table (18).

6. A plant for automatic folding of metal sheets of different dimensions comprising at least one folding press, means for displacement of the said metal sheets, and at least one numerically controlled robotised handling device operable to position the said metal sheets selectively, one at a time, in a plurality of predetermined positions in which the said metal sheets are workable by the said folding press, characterized by the fact that it includes a rotatable base disposed between the said handling device and the said folding press and a support table for the said metal sheet which can be fixed for rotation with the said base, this latter and the said handling device being controlled by a common central control unit and the said handling device including means for gripping simultaneously both said metal sheet and said support table when the latter is lying on said support table.

7. A plant according to claim 6, characterised by the fact that it includes a store (25) disposed adjacent the said rotatable base (16) and a plurality of support tables (18) which can be selectively secured to the said base (16) and having different dimensions, the said tables (18) being housed in the said store (25) and the said handling device (8) being operable to withdraw the said tables (18) selectively from the said store and to dispose them on the said base (16), which is provided with a self centering attachment device (19) for the said tables (18).

8. A plant according to claim 6, characterised by the fact that the said numerically controlled handling device (8) includes two mechanical pincers (10) which can be brought together or spaced apart from one another, which are rotatable through 360° about an axis parallel to the plane in which they lie, each of the said pincers (10) including a pair of jaws (11,12) having at least two adjacent gripping sides (13, 14) disposed substantially at a right angle to one another.

9. A plant according to claim 8, characterised by the fact that the said pincers (10) include means (28) for supporting the said support table (18) independently from one of the said metal sheets (2) lying on the table (18) and gripped by the said jaws (11, 12).

10. A plant according to claim 9, characterised by the fact that the said support table (18) includes a perimetral edge (26) provided with a continuous groove (27), the said means for supporting the said table (18) including respective elastomeric plugs (23) operable to engage with the said groove (27) and carried projecting from respective lower jaws (11) of the said pincers (10).

11. A plant according to claim 6, wherein said support table includes means for co-operating with said gripping means of said handling device in order to be grippable by the said handling device together with one of the said metal sheets resting thereon and rigidly connected thereto.

* * * * *